United States Patent [19]

Tullin

[11] Patent Number: 4,478,475

[45] Date of Patent: Oct. 23, 1984

[54] METHOD AND PLUG FOR SECURING A CONNECTING WIRE TO A TUBULAR PIN

[75] Inventor: Flemming Tullin, Ballerup, Denmark

[73] Assignee: Ortofon Manufacturing A/S, Valby, Denmark

[21] Appl. No.: 534,941

[22] PCT Filed: Jul. 16, 1980

[86] PCT No.: PCT/DK80/00044

§ 371 Date: Mar. 2, 1981

§ 102(e) Date: Mar. 2, 1981

[87] PCT Pub. No.: WO81/00328

PCT Pub. Date: Feb. 5, 1981

Related U.S. Application Data

[63] Continuation of Ser. No. 243,918, Mar. 2, 1981, abandoned.

[30] Foreign Application Priority Data

Jul. 17, 1979 [DK] Denmark ..... 2992/79

[51] Int. Cl.[3] ..... H01R 4/50

[52] U.S. Cl. ..... 339/97 R; 29/857; 339/273 F

[58] Field of Search ..... 339/17 R, 17 C, 95 R, 339/96, 97 R, 100, 221 R, 221 M, 247, 273 R, 273 F; 24/115 M, 136; 29/857; 411/388, 389, 460

[56] References Cited

U.S. PATENT DOCUMENTS

| | | | |
|---|---|---|---|
| 2,523,797 | 9/1950 | Weisberg | 339/247 |
| 3,014,140 | 12/1961 | Tupper | 339/97 R |
| 3,461,768 | 8/1969 | Ultes, Jr. | 411/389 |
| 3,492,629 | 1/1970 | Hirsch | 339/97 |
| 3,824,554 | 7/1974 | Shoholm | 339/221 R |
| 3,951,503 | 4/1976 | Caulkins | 339/100 |
| 4,057,315 | 11/1977 | Miller et al. | 339/221 R |
| 4,059,330 | 11/1977 | Shirey | 339/221 R |
| 4,270,824 | 6/1981 | Erickson | 339/273 R |

FOREIGN PATENT DOCUMENTS

| | | | |
|---|---|---|---|
| 262414 | 6/1968 | Austria | 339/273 |
| 1935373 | 1/1971 | Fed. Rep. of Germany | 339/273 F |
| 2406551 | 8/1975 | Fed. Rep. of Germany | 339/97 R |
| 850841 | 10/1960 | United Kingdom . | |
| 970226 | 9/1964 | United Kingdom | 339/97 |

*Primary Examiner*—Neil Abrams

*Attorney, Agent, or Firm*—Fleit, Jacobson, Cohn & Price

[57] ABSTRACT

For the purpose of securing a thin, enamelled wire (15) to a tubular plug pin (10), whose one end is embedded in a massive block (14), the wire (15) is clamped in the pin (10) by means of a plug (16) which is conical at both ends and may thus, no matter how it faces, be forced into the pin (10) to clamp the wire (15) to a flattened state there so that its enamel bursts, which provides an effective electrical contact.

2 Claims, 1 Drawing Figure

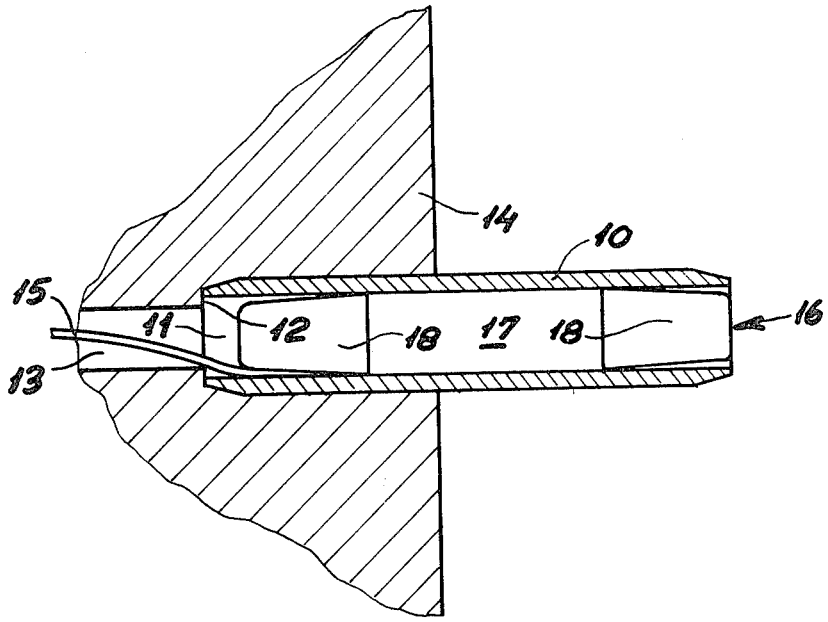
14
10
15
11
12
18
17
18
16
13

METHOD AND PLUG FOR SECURING A CONNECTING WIRE TO A TUBULAR PIN

This application is a continuation of application Ser. No. 243,918, filed Mar. 2, 1981 now abandoned.

The invention relates to a method of the type described wherein a thin connecting wire is secured to a tubular pin whose one end is embedded or pressed into a hole in a massive block, preferably of plastics, by clamping the wire in the pin.

The miniaturization of electrical and electronic components, which has for many years characterized the technological development in this field, has inter alia resulted in a need for ever smaller plug pins for various types of replaceable units, e.g. pickup units. The wires used for establishing a connection between the coils of such a unit and the pins are so thin that it is difficult to secure them by soldering. It is known to avoid these difficulties by using a relatively short, slightly conical plug which is forced into the tubular pin and clamps the wire between the plug and the tube wall. The largest diameter of the plug is approximately the same as the internal diameter of the tube so that the end portion of the wire is flattened and the enamel bursts which provides a good electrical contact even though the wire is insulated. In other words, it is not necessary to deinsulate the wire before it is secured to the pin.

The object of the invention is to provide a method of said type which is more suitable for being carried out automatically than the known one.

This object is achieved by carrying out the method as defined herein because this execution of the process renders it unimportant how the plugs face when fed to the piston that forces them into the plug pins. This is a great advantage in practice because the very small plugs, which may e.g. have a length of 5.3 mm and a diameter of 0.55 mm, are very difficult to orient in a specific direction.

When the largest diameter of the plug is equal to the internal diameter of the tube the wire is cut as the plug is inserted, and the thickness of the wire gradually decreases at the clamped section from full wire diameter to zero. The plug also braces the pin, and to this end the plug may suitably have substantially the same length as the pin.

The invention also relates to a plug for use in the carrying out of the said method, the characteristics of the plug of the invention being defined herein.

The invention will be explained more fully below with reference to the drawing, which shows a greatly increased section of an embedded plug pin in which a connecting wire is secured by the method and plug of the invention.

In the drawing 10 is a tubular plug pin which is chamfered at the ends and whose one end is located in a cylindrical hole 11 in abutment on a shoulder 12 defined between the hole 11 and a co-axial hole 13 of reduced diameter in a plastics block 14, which may e.g. be part of the housing of a pickup unit. The pin 10 comprises a connecting wire 15 which extends through the hole 13 and is clamped between the tube wall and a plug 16 which is forced into the tube 10 from its free end. The plug 16 has an uninterrupted cylindrical central portion 17 and two conical end portions 18. The conical end portions are substantially the same and evenly merge into the central portion of the plug. Additionally, the end portions are gradually tapering and have blunt ends, the radius of the plug at the outermost end of each conical end portion being no greater than the difference between the inner radius of the pin less the diameter of the wire. The central portion 17 has at least approximately the same diameter as the tube hole. Before the plug is inserted the wire 15 is extended through the entire tube. As the plug is inserted the wire is cut, and the clamped end portion of the wire is flattened so that its thickness decreases from full diameter at the front portion of the conical end portion 18 to zero at the transition between said end portion and the cylindrical central portion 17. As shown, the plug 16 is inserted so far that the central portion 17 extends a distance into the area of the pin 10 which is enclosed by plastics material. This ensures an effective and stable electrical connection between wire and pin and also the increase in stiffness of the thin pin that makes it suitable for its purpose.

I claim:

1. A method of securing a thin, enamelled connecting wire to a tubular plug pin having an inner end embedded in a block having a hole coaxial with the plug pin, said method comprising:

(a) inserting said wire through the hole in said block and through said plug pin;

(b) providing an insertion plug having a cylindrical central portion substantially equal in diameter to the internal diameter of said tubular plug pin and having a conical end at each end thereof;

(c) positioning either end of said insertion plug opposite the outer end of said plug pin; and (d) pressing against the outermost end of said insertion plug with a piston to insert said insertion plug into the outer end of said plug pin until the central portion of said plug passes beyond the surface of and into the interior of said block to cut said wire by wedging action on said wire between said insertion plug and said plug pin and provide a wire end, and to flatten said wire end and burst the enamel coating so that the thickness of the wire decreases from full diameter at the innermost end of said insertion plug to substantially zero at the point where said conical end and said cylindrical central portion meet to thereby clamp said wire between said insertion plug and said plug pin to provide an electrical connection therebetween.

2. A pick-up unit having an outwardly extending plug pin for establishing electrical connection with a wire within said unit, said electrical connection comprising:

(a) a pick-up body having a hole extending into said body and having a first diameter, said hole including an enlarged portion adjacent the surface of said body, said enlarged portion extending partially into said body to a termination point and having a second diameter concentric with said first diameter, and an inwardly directed shoulder at said termination point;

(b) a tubular plug pin positioned within the enlarged portion of said hole and having an end extending outwardly of said hole, the other end of said plug abutting said shoulder;

(c) an insertion plug having a cylindrical central portion and conical portions at each end thereof having substantially the same configuration, said central portion having a diameter substantially equal to the inner diameter of said plug pin, said insertion plug positioned within said plug pin with the central portion of said insertion plug extending to a point beyond the surface of said pick-up body; and (d) a thin, enamelled wire positioned within said hole in said pick-up body, said wire having an end extending from the cylindrical portion of said insertion plug inwardly of said hole, said wire being clamped between said insertion plug and said plug pin, the clamped end being flattened from a thickness of zero at the point where the cylindrical portion joins the innermost conical portion of said insertion plug to full diameter at the innermost conical end, the enamel on said clamped end being in burst condition to provide good electrical contact between said wire and said plug pin, said conical end portions of said insertion plug having a diameter at the outermost ends thereof that is no greater than the difference between the inner diameter of said tubular plug pin and two diameters of said wire whereby either end of said plug can be inserted into said plug pin to effect the connection of said wire thereto.

* * * * *